US005522314A

United States Patent [19]

Newman, Jr.

[11] Patent Number: 5,522,314

[45] Date of Patent: Jun. 4, 1996

[54] METHOD FOR ACCURATELY POSITIONING BORDER STRIPS ON FABRIC

[76] Inventor: Eugene F. Newman, Jr., 7946 Stonehurst Dr., Dublin, Ohio 43017-9099

[21] Appl. No.: 335,253

[22] Filed: Nov. 7, 1994

[51] Int. Cl.[6] ..... B41L 13/02

[52] U.S. Cl. ..... 101/128.4; 101/127.1; 101/128.1; 101/415.1; 38/102.4

[58] Field of Search ..... 101/127.1, 127, 101/128.1, 128.4, 129, 407.1, 128, 415.1; 38/102.4

[56] References Cited

U.S. PATENT DOCUMENTS

| | | | |
|---|---|---|---|
| 2,903,967 | 9/1959 | Levin | 101/415.1 |
| 3,078,793 | 2/1963 | Jaffa et al. | 101/127.1 |
| 3,211,089 | 10/1965 | Messerschmitt | 101/127.1 |
| 3,416,445 | 12/1968 | Krueger, Jr. | 101/128.1 |
| 3,991,677 | 11/1976 | Barnes | 61/127.1 |
| 4,525,909 | 7/1985 | Newman | 38/102.1 |
| 4,649,817 | 3/1987 | Smith | 101/129 |
| 5,003,870 | 4/1991 | Isaan | 101/128.4 |
| 5,063,842 | 9/1991 | Clarke | 101/128.1 |
| 5,220,867 | 6/1993 | Carpenter | 101/127.1 |
| 5,274,934 | 1/1994 | Newman, Jr. | 101/128.1 |
| 5,327,828 | 7/1994 | Barocas et al. | 101/127.1 |
| 5,390,596 | 2/1995 | Farr | 101/129 |
| 5,398,602 | 3/1995 | Taylor | 101/129 |

FOREIGN PATENT DOCUMENTS

| | | | |
|---|---|---|---|
| 2304934 | 8/1974 | Germany | 101/127.1 |
| 2920874 | 12/1980 | Germany | 101/127.1 |
| 3270938 | 12/1991 | Japan | 101/129 |

OTHER PUBLICATIONS

"Screen Tensioning" Screen Printing pp. 48–53, 110, 112 Feb. 1984.

"Lock and Roll" Tetro, ShurLoc Advertisement Jul., 1995 Screen Printing Magazine Circle Readercard.

*Primary Examiner*—Eugene H. Eickholt

[57] ABSTRACT

A method of accurately positioning border strips on fabric as used in screen printing. The method involves stretching fabric to a prescribed tension and attaching border strips in predetermined positions while the fabric is at the prescribed tension. The combined fabric and border strips can then be stretched onto a prescribed frame with the fabric attaining a prescribed tension.

7 Claims, 5 Drawing Sheets

METHOD FOR ACCURATELY POSITIONING BORDER STRIPS ON FABRIC

BACKGROUND OF THE INVENTION

1. Field of the Invention

The present Invention relates in general to stretching fabric and in particular to stretching screen printing fabric.

2. Background Information

In U.S. Pat. No. 3,991,677 by V. H. Barnes, U.S. Pat. No. 3,211,089 by Elmar Messerschmitt, U.S. Pat. No. 3,416,445 by T. H. Krueger, U.S. Pat. No. 2,903,967 by H. S. Levin, and U.S. Pat. No. 3,078,793 by D. Jaffa et al references are made to using fabric border strips to releaseably attach to frames with the object of tightly stretching fabric as used in screen printing. In none of these patents is there a discussion of the size and shape of the fabric and the exact positions of the border strips on the fabric. There are insufficient means in the screen devices of these patents to precisely position and lock the border strips on these frames. Thus, there is an imprecision regarding how much fabric material is within the area inside the border strips because the border strips may be set at imprecise distances apart and the distance the fabric is stretched may vary because there is no precise control of the stop positions of the border strips on the frames. In U.S. Pat. No. 5,274,934 by this author, a screen apparatus is described wherein the border strips are in precisely measured locations on fabric and the frame has fastening features in precisely measured and predetermined locations. Unlike the Barnes, Messerschmidtt, Krueger, Levin, and Jaffa inventions in which the fabric is stretched an indefinite distance, this invention has as an object, the stretching of the fabric to a predetermined distance so as to attain a predetermined tension in the fabric. But because screen fabric, especially very finely woven fabric of silk, polyester, or nylon, has almost no rigidity, it is very difficult to position the fabric accurately so as to consistently place an equal amount of fabric within the area bounded by the border strips when attaching the border strips to the fabric. Thus, there is a problem of making bordered fabric with a high degree of precision regarding the location of the border strips on the fabric. An object of this invention is to describe a method to overcome this problem.

Pneumatic, mechanical, and other stretchers are well known by persons skilled in the art of stretching screen fabric. It is not known, however, how to use these stretchers in a method of attaching border strips to fabric to attain a highly accurate placement of the border strips on coordinates of the fabric. An object of this invention is to describe such a method.

SUMMARY OF THE INVENTION

This invention is a method of attaching border strips to fabric that comprises the following steps;

1) fabric is placed flatly on a platen with four sides so that the fabric covers the platen beyond the edges of the platen, 2) a plurality of stretchers in predetermined and precisely measured positions on each of the four sides of the platen grip the fabric, 3) the stretchers pull outward pneumatically, mechanically, or by other means so that each fabric stretcher pulls the fabric with an equal force, 4) the amount of force is regulated so as to stretch the fabric to a predetermined tension, 5) border strips positioned in precise locations in relation to the coordinates of said platen are attached to the stretched fabric, 6) the stretchers return to their former positions and release the fabric, and 7) the combined fabric and border strips are removed from the platen.

If the weave of the fabric is identical for each piece of fabric, inevitable variations in the size and shape of fabric on the platen are adjusted for in this stretching method so that the border strips will nevertheless attach to the fabric in positions that assure that when the combined fabric and border strips are stretched onto a prescribed frame, the fabric will attain a prescribed tension. Likewise, if the weave of the fabric is different for each piece of fabric, the border strips will nevertheless attach to the fabric in positions that assure that when the combined fabric and border strips are stretched onto a prescribed frame, the fabric will attain a prescribed tension. Differences in the weaves of fabric will necessitate differences in the amount of force and stretch distance required to attain a specific tension in the fabric. The force and stretch distances are increased or decreased by reading fabric tension meters and increasing or decreasing the pulling force of the stretchers as needed to attain a specific tension in the fabric. Once a specific tension in the fabric is attained, the precisely spaced border strips can be attached to the fabric.

A modification to this method is made for when the pulling force of the stretchers is modulated so as to be progressively greater nearer the middle of each side. This pulling pattern is designed to put a predetermined greater tension in the center of the fabric piece to compensate for deflection or bowing of screen frame sides that occurs when screen frames are stressed by high fabric tension. This bowing causes an undesireable drop in screen tension below what was originally targeted. By empirically testing this tension loss, a compensating additional tension can be put into the fabric in a pattern that offsets the bowing of the screen frame. Such a pattern comprises generally more tension put on the middle of each side of the fabric by a progressively greater pulling force of the stretchers nearer the middle of each side of the fabric. There results a disparity of tension in the fabric at the time the border strips are attached. When the combined fabric and border strips are stretched onto a prescribed frame, this pattern of greater tension in the middle of each side of the fabric exactly offsets the pattern of tension loss caused by the bowing of the frame sides.

Another modification to this method is made for border strips comprising curved shapes substantially the same as the deflection curves of tensioned screen frame sides. Said curved border strips are attached to the stretched fabric in precise precalculated positions in relation to coordinates of the platen during the attachment step. When the combined fabric and border strips are stretched onto a prescribed frame, the curves of the border strips match the curves of the deflected sides of the frame and there is no bowing of the fabric and, therefore, no loss of tension in the fabric due to frame deflection.

DETAILED DESCRIPTION

The method for accurately positioning border strips on fabric comprises placing the fabric, 1, flatly onto a platen, 2, so that said fabric covers said platen beyond the edges of said platen as in FIGS. 1, 2, 4, and 5. Said platen comprises grooves or fixtures, 6, into which are affixed border strips. In the preferred method, said grooves or fixtures are curved, as in FIG. 4, so as to substantially have the same curvature as the deflected sides of a prescribed screen frame, 9, under a prescribed screen tension as in FIG. 3. The preferred method comprises a plurality of stretchers, 3, on each side of the fabric which are positioned in precisely precalculated positions in relation to coordinates of the platen, 2, as in FIG. 4. Said stretchers grip said fabric and pull outwardly with an equal force from each stretcher and with each stretcher having a mobility to move sideways in response to forces in these directions. The greater the number of stretchers, the more even the tension in the fabric is. Pneumatic stretcher systems with one compressed air source servicing all the stretchers are effective systems for distributing an equal force, 4, to said stretchers, 3. To attain a prescribed tension in said fabric, said force can be raised or lowered until the desired tension is read on a tension meter that indicates the tension in the fabric. Once said fabric has attained the prescribed tension and the border strips are positioned in precise predetermined locations in relation to coordinates of said platen, the border strips can be attached to said fabric. The attachment may comprise bonding with glue, molding, welding, heat sealing, or any other means of attachment. With the border strips attached, said force can be reduced, said stretchers released, and the combined fabric and border strips removed from said platen. The combined fabric and border strips can then be stretched onto a prescribed frame with border strip engagement coordinates matching the coordinates of said grooves or fixtures in said platen. The stretched fabric will then have the same tension as it had during the border strip attachment process.

Figure 1:
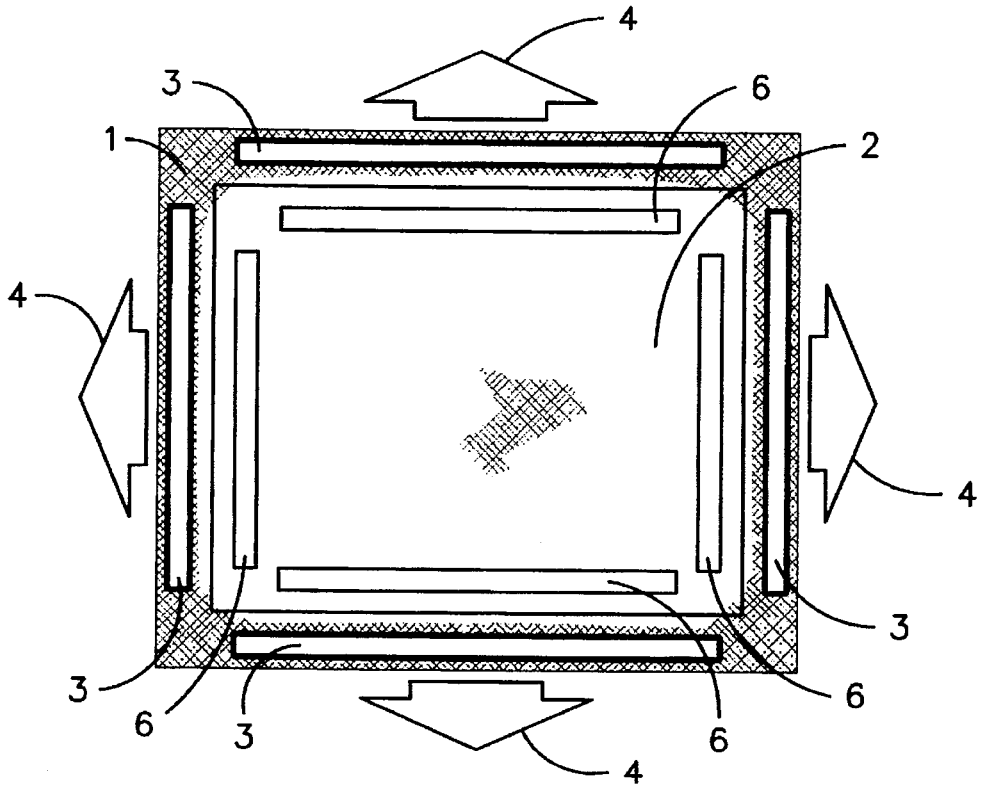
FIG. 1 is a top view of fabric being stretched by one stretcher on each side of a piece of fabric with a platen having straight grooves or fixtures for affixing straight border strips.

An alternative method for accurately positioning border strips on fabric comprises placing the fabric, 1, flatly on a platen, 2, so that said fabric covers said platen beyond the edges of said platen as in FIG. 1. This method comprises grooves or fixtures, 6, that are straight and comprises only one stretcher, 3, on each side of said platen. The steps in this alternative method are the same as the preferred method but because only one stretcher, 3, is used per side of said platen, the fabric, 1, will have a distortedly higher tension in the comer areas. The distortedly higher tension in the corner areas may be mitigated by shortening the length of said stretchers relative to said platen so as to leave said fabric free and unstretched in these areas, reducing the likelihood of tearing said fabric in the corner areas. This alternative method will not compensate for the drop in tension in the screen fabric when the combined fabric and border strips are stretched onto a screen frame because the border strips are straight rather than curved during the attachment step.

Figure 6:
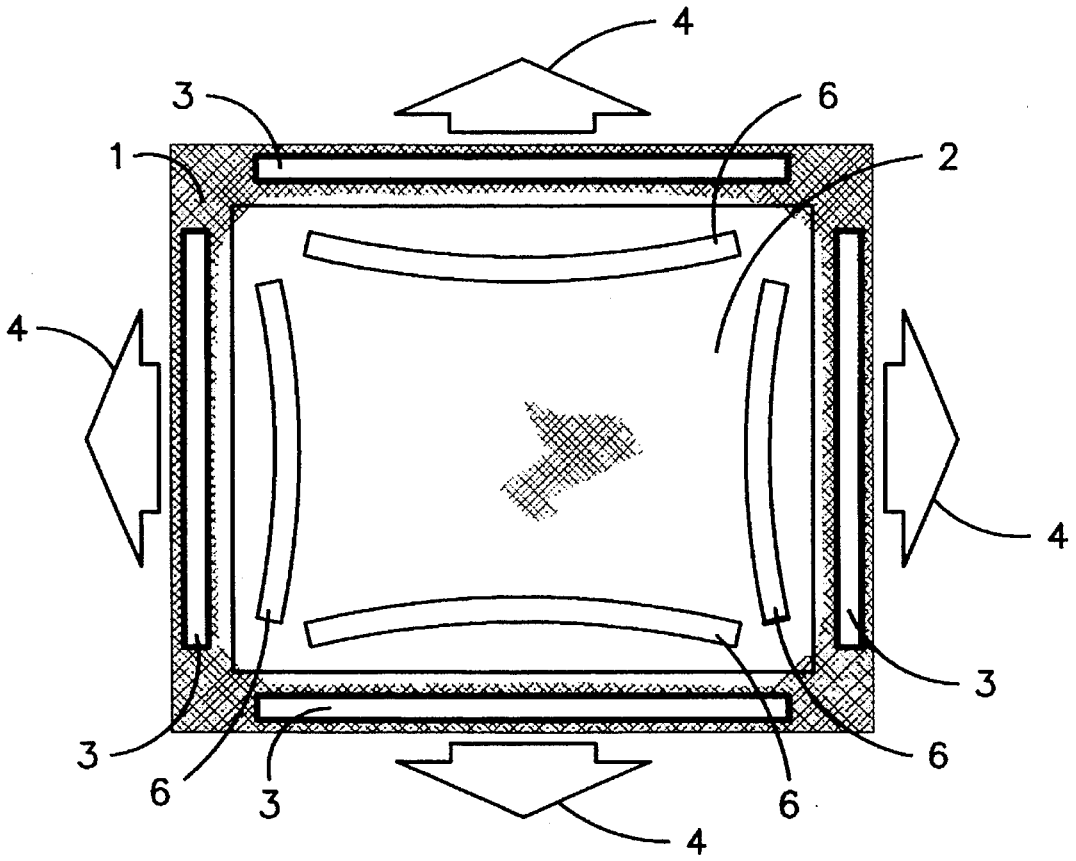
FIG. 6 is a top view of fabric being stretched by one stretcher on each side of a piece of fabric with a platen having curved grooves or fixtures for affixing curved border strips.

Another alternative method for accurately positioning border strips on fabric comprises placing the fabric, 1, flatly on a platen, 2, so that said fabric covers said platen beyond the edges of said platen as in FIG. 6. This method comprises grooves or fixtures, 6, that are curved so as to substantially have the same curvature as the deflected sides of a prescribed screen frame, 9, under a prescribed tension as in FIG. 3. This method comprises only one stretcher, 3, on each side of said platen. The steps in this alternative method are the same as in the preferred method, but because only one stretcher, 3, is used per side of the platen, 2, there will be a distortion of tension in said fabric in the corners areas as described earlier.

Figure 2:
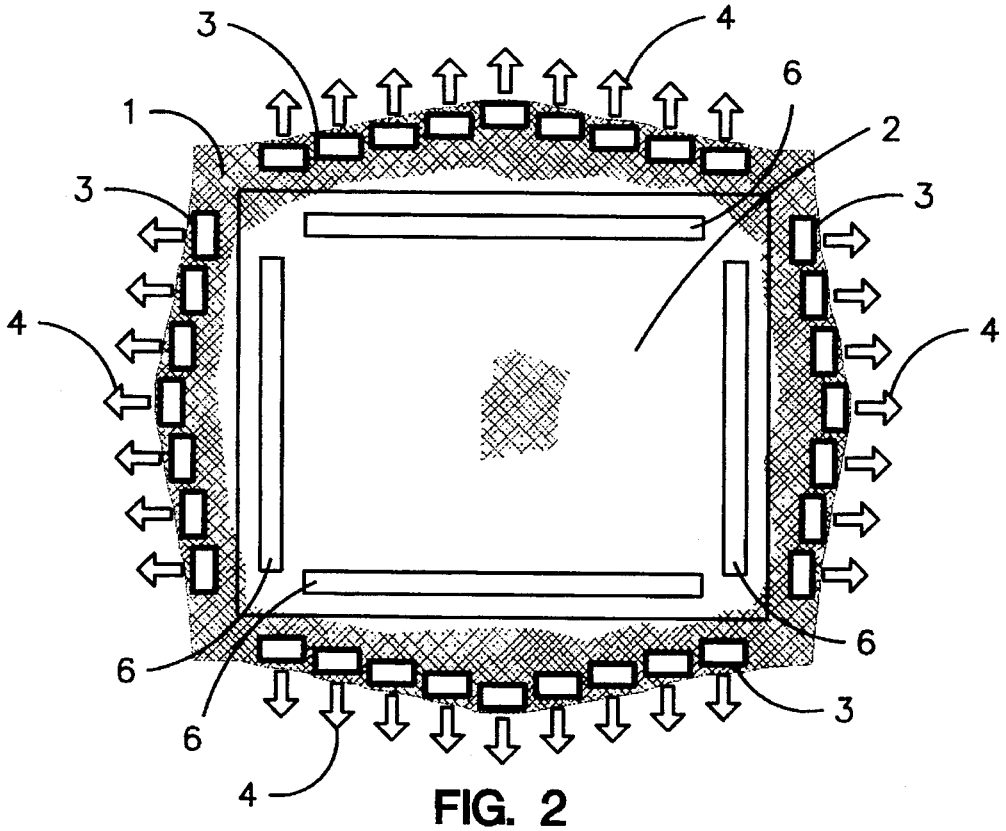
FIG. 2 is a top view of fabric being stretched by a plurality of stretchers on each side of a piece of fabric with a platen having straight grooves or fixtures for affixing straight border strips.
Figure 3:
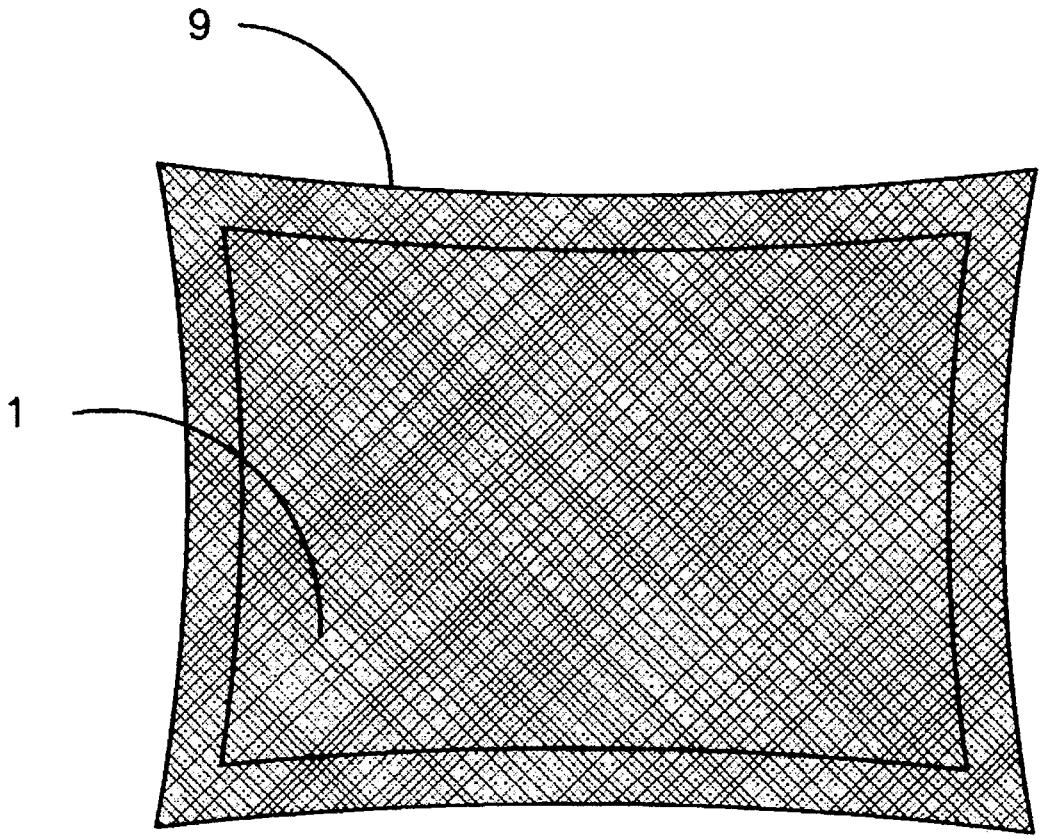
FIG. 3 is a top view of a screen frame with bowed sides as a result of high fabric tension in the screen.
Figure 4:
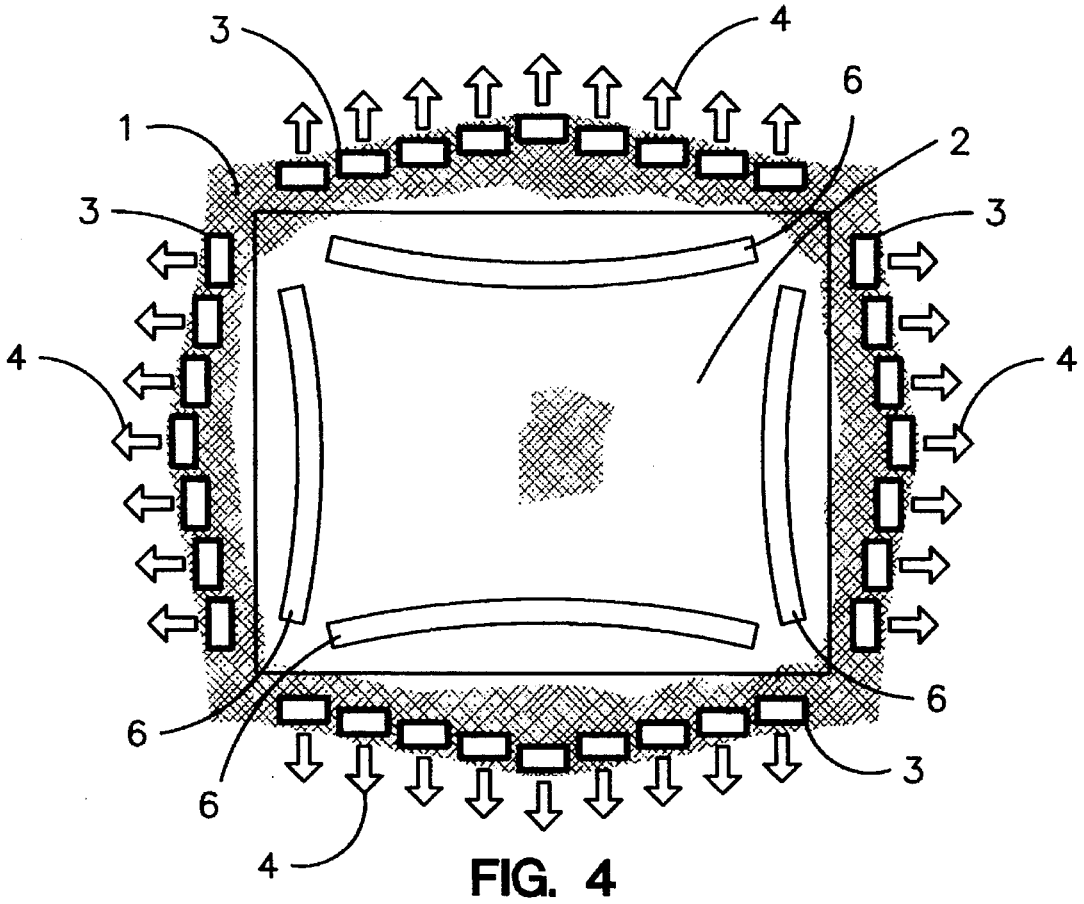
FIG. 4 is a top view of fabric being stretched by a plurality of stretchers on each side of a piece of fabric with a platen having curved grooves or fixtures for affixing curved border strips.

Another alternative method for accurately positioning border strips on fabric comprises placing the fabric, 1, flatly on a platen, 2, so that said fabric covers said platen beyond the edges of said platen as in FIG. 2. This method comprises grooves or fixtures, 6, that are straight and this method comprises a plurality of stretchers, 3, on each side of the platen, 2. The steps in this alternative method are the same as in the preferred method, but because the border strips are straight rather than curved during the attachment step, this alternative method will not compensate for the drop in tension in the screen fabric when the combined fabric and border strips are stretched onto a screen frame.

Figure 5:
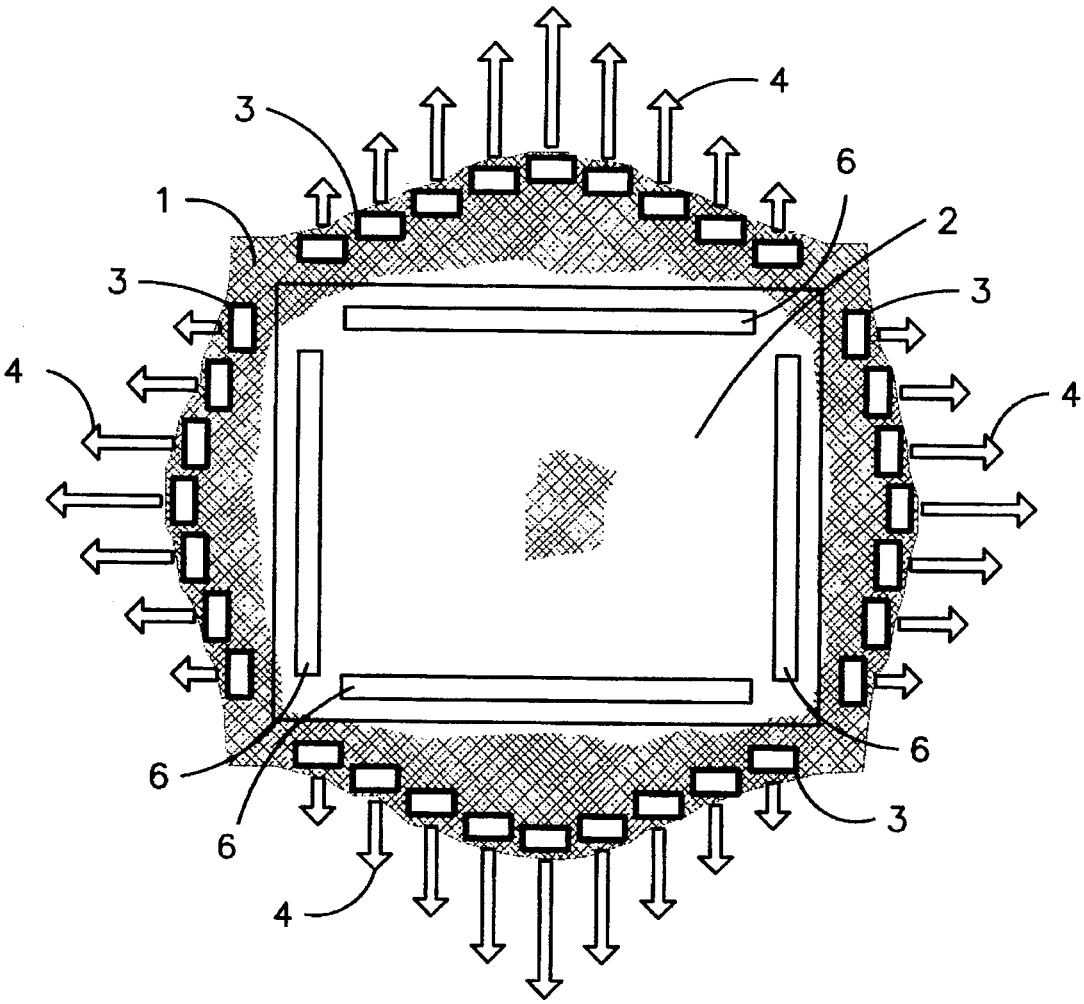
FIG. 5 is a top view of fabric being stretched by a plurality of stretchers on each side of a piece of fabric with a pattern of relatively greater pulling force in the stretchers toward the center of each side and with a platen having straight grooves or fixtures for affixing straight border strips.

Another alternative method for accurately positioning border strips on fabric comprises placing the fabric, 1, flatly on a platen, 2, so that said fabric covers said platen beyond the edges of said platen as in FIG. 5. This method comprises grooves or fixtures, 6, that are straight and this method comprises a plurality of stretchers, 3, on each side of said platen. The steps in this alternative method are the same as in the preferred method with the exception that there is a pattern of progressively greater pulling force from said stretchers nearer the middle of each side of said fabric. This pattern of pulling force is calculated to produce a pattern of additional tension in said fabric that will compensate for the pattern of tension loss in said fabric that is caused by the deflection of a prescribed screen frame, 9, as in FIG. 3 when the combined fabric and border strips are stretched onto said frame.

The foregoing description of the preferred method of the invention has been presented for the purpose of illustration and description. It is not intended to be exhaustive or to limit the invention to the precise forms described. Many modifications and variations are possible in the light of the above teaching. It is intended that the scope of the invention not be limited by this detailed description, but rather by the claims appended hereto.

What is claimed is:

1. A method of accurately positioning and attaching border strips on fabric using a platen, fabric, stretchers in predetermined precise locations in relation to coordinates of said platen on each side of said platen, means to control the force exerted by said stretchers, border strips, means for positioning said border strips in precise locations in relation to the coordinates of said platen, means for measuring the tension in said fabric, and a prescribed screen frame with border strip engagement features in a prescribed pattern of precisely predetermined locations, said method comprising the steps of:

(a) placing said fabric flatly on said platen;

(b) gripping said fabric with said stretchers;

(c) stretching said fabric;

(d) measuring the tension in said fabric;

(e) controlling the amount of force by which said stretchers stretch said fabric;

(f) attaining and maintaining the stretching force of said stretchers at a level that achieves a specific prescribed tension in said fabric;

(g) placing and holding said border strips in precisely measured and predetermined locations relative to the coordinates of said platen and in a pattern that has a relationship to said prescribed pattern of precisely predetermined locations of said engagement features of said prescribed frame;

(h) attaching said border strips to said fabric;

(i) reducing the force exerted by said stretchers with said stretchers returning to their former positions;

(j) releasing said fabric from said stretchers;

(k) removing the combined fabric and border strips from said platen.

2. The method defined in claim 1, wherein said means for positioning said border strips in precise locations in relation to coordinates of said platen positions border strips comprising curvatures substantially the same as the curvatures of deflected sides of a prescribed screen frame at a prescribed tension.

3. The method defined in claim 1, comprising a plurality of stretchers on each side of said platen.

4. The method defined in claim 1, wherein said means for positioning said border strips in precise locations in relation to coordinates of said platen positions border strips comprising a substantially straight form.

5. The method defined in claim 1, comprising only one stretcher on each side of said platen.

6. The method defined in claim 1, wherein said means for controlling said force exerted by said stretchers controls said force so as to establish a pattern of gradually greater stretching of said fabric toward the middle of each side of said platen, said pattern calculated to substantially offset the pattern of lost tension in said fabric resulting from the deflection of the sides of said prescribed screen frame at a prescribed tension.

7. The method defined in claim 1, comprising a plurality of stretchers on each side of said platen, wherein said stretchers are free to move laterally in response to forces exerted on said stretchers during stretching of said fabric.

* * * * *